US011280534B2

(12) United States Patent
Mishra et al.

(10) Patent No.: US 11,280,534 B2
(45) Date of Patent: Mar. 22, 2022

(54) COOLING APPARATUS AND METHOD OF USING THE SAME

(71) Applicant: Purdue Research Foundation, West Lafayette, IN (US)

(72) Inventors: Dharmendra k Mishra, West Lafayette, IN (US); Ferhan Ozadali, West Lafayette, IN (US); Fernanda San Martin-Gonzalez, West Lafayette, IN (US); Bruce M Applegate, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 189 days.

(21) Appl. No.: 16/537,567

(22) Filed: Aug. 10, 2019

(65) Prior Publication Data

US 2020/0049397 A1 Feb. 13, 2020

Related U.S. Application Data

(60) Provisional application No. 62/717,061, filed on Aug. 10, 2018.

(51) Int. Cl.
*F25D 3/00* (2006.01)

(52) U.S. Cl.
CPC ..... *F25D 3/00* (2013.01); *F25D 2400/28* (2013.01)

(58) Field of Classification Search
CPC ..... F25D 3/00; F25D 2400/28; A23L 3/375; A23L 3/3409; A23L 3/3418; A23L 3/3589
See application file for complete search history.

(56) References Cited

U.S. PATENT DOCUMENTS 3,068,105 A * 12/1962 Morrison ..... A23G 9/04 62/70
4,237,695 A * 12/1980 Oberpriller ..... F25D 3/11 62/332
4,951,472 A * 8/1990 Hansen ..... A23C 19/0976 62/380

(Continued)

OTHER PUBLICATIONS

Popov et al., Cryogenic heat exchangers for process cooling and renewable energy storage: A review, Applied Thermal Engineering, vol. 153, 2019, 275-290.

(Continued)

*Primary Examiner* — Joseph F Trpisovsky
(74) *Attorney, Agent, or Firm* — Piroozi-IP, LLC

(57) ABSTRACT

A rapid cooling system for processing food is disclosed which includes a heat exchanger adapted to receive a first coolant (Coolant-I) at a first temperature and eject Coolant-I at a second temperature, a cooling chamber disposed within the heat exchanger in thermal communication with the heat exchanger, the cooling chamber includes a first inlet adapted to receive a product at an elevated temperature (T1), a second inlet adapted to receive a second coolant (Coolant-II) at a low temperature (T2), and an outlet adapted to release a combination of the product and Coolant-II at a low temperature ($T_{out}$) and pressure ($P_{out}$), wherein cooling of the product from T1 to $T_{out}$ does not cause a phase change in the product.

20 Claims, 2 Drawing Sheets

(56) References Cited

U.S. PATENT DOCUMENTS

| | | | | |
|---|---|---|---|---|
| 5,201,165 | A | 4/1993 | Marano et al. | |
| 6,531,173 | B2 | 3/2003 | Booker | |
| 7,781,006 | B2 * | 8/2010 | Brisson, II | A23G 9/08 426/565 |
| 8,470,383 | B2 * | 6/2013 | Rasanayagam | A23L 3/3589 426/327 |
| 9,746,250 | B2 | 8/2017 | Sandu | |

OTHER PUBLICATIONS

Singh et al., Design of a cryogenic grinding system for spices, Journal of Food Engineering, vol. 39, 1999, 359±368.

Zheng et al., Vacuum cooling for the food industry—a review of recent research advances, Trends in Food Science & Technology, vol. 15, 2004, 555-568.

Feng et al., Vacuum Cooling of Meat Products: Current Stateof-the-Art Research Advances, Critical Reviews in Food Science and Nutrition,vol. 52, 2012, 1024-1038.

* cited by examiner

COOLING APPARATUS AND METHOD OF USING THE SAME

CROSS-REFERENCE TO RELATED APPLICATIONS

The present patent application is related to and claims the priority benefit of U.S. Provisional Patent Application Ser. No. 62/717,061 filed Aug. 10, 2018, the contents of which are hereby incorporated by reference in its entirety into the present disclosure.

STATEMENT REGARDING GOVERNMENT FUNDING

This invention was not made with government support.

TECHNICAL FIELD

The present disclosure generally relates to food processing, and in particular, to a cooling apparatus suitable in food processing technology.

BACKGROUND

This section introduces aspects that may help facilitate a better understanding of the disclosure. Accordingly, these statements are to be read in this light and are not to be understood as admissions about what is or is not prior art.

Over the years, there has been a considerable amount of effort to improve quality of thermally processed foods and retain nutrients as much as possible. This is usually done through optimization of the thermal process and selecting the time-temperature combination that will result in a food product with maximum nutrient retention without compromising food safety objectives. The goal of thermal processing of foods is the destruction of microbes that can result in harmful effects both for human health and food spoilage. Retort thermal processing is one of the oldest forms of processing low acid foods. In such processing, there are two competing interests: 1) destruction of microbes, while 2) preserving quality of food. Due to the heat load in a retorted container, the quality of the product is often compromised in order to achieve the commercial sterility. FIG. 1 is a graph of time in minutes vs. temperature in ° C., which represents the effect of time and temperature on spore destruction and retention of quality in food products. Higher temperature inactivates the microorganisms faster than the nutrients such as vitamin C. This is due to the fact that the nutrients are more resistant to heat than the microorganisms. The operating temperature ranges of aseptic thermal processes are designed based on the optimization of quality while keeping the food safe from microorganisms of concern. Hence, aseptic processing is conducted at much higher temperatures than the retort process.

A significant advancement in thermal processing was processing the product at higher temperatures for significantly shorter times (High Temperature Short Time, HTST or Ultra High Temperature, UHT processing systems), where the product is sterilized separately from the containers and then filled and sealed in a sterile environment. The entire system is known as Aseptic processing and packaging. Advantages of aseptic systems over conventional thermal processing systems (e.g. retorts) were that the product could be heated up rapidly in a continuous format separate from the container. Due to shorter retention times and less heat abuse, aseptic processing allows the industry to retain higher amounts of quality nutrients compared to conventional canning processes.

Over-heating and under-heating are two major concerns for the food industry. Due to food safety concerns and limitations of the proper control systems, the food industry tends to over-process the products. To ensure a safe product, heat-resistant pathogenic or spoilage organisms that grow at expected storage temperatures must be considered. One such organism is *Clostridium botulinum* in low-acid foods. The thermal process is designed in such a way that the probability of survival of *C. botulinum* spores in low-acid foods is no higher than one in $10^{12}$. If the thermal process is more conservative in nature, then it tends to over-process the product. Over-processing of the food product leads to the loss of vital nutrients and lower overall quality of the product, whereas under-heating the product leads to product spoilage due to microbial growth and poses health concern for the consumers. Hence, it is important to optimize the processing conditions to achieve the highest nutritional retention and keep the product safe from microorganism growth at the same time.

No matter how the heating takes place, once heated, the food needs to be cooled prior to packaging. Any improvement in exposure time during the cooling phase of the aseptic process would bring many benefits and enhance the benefits of recently developed heating technologies (e.g. continuous microwave heating). However, there has been a lack of attention in cooling technology development that can further maximize the nutrient retention and provide better quality food to consumers. In addition to quality improvement, the availability of a rapid cooling technology will provide opportunities to save initial capital and energy costs and to make the manufacturing process more sustainable. However, the cooling cannot be such that there is a phase change, i.e., liquid to solid, e.g., by freezing the product.

Therefore, there is an unmet need for a novel approach in cooling or rapid cooling foods that have been heated for the purpose of destroying microorganism that avoids a phase change in the product during the cooling process.

SUMMARY

A rapid cooling system for processing food is disclosed. The system includes a heat exchanger adapted to receive a first coolant (Coolant-I) at a first temperature and eject the first coolant at a second temperature. The system also includes a cooling chamber disposed within the heat exchanger in thermal communication with the heat exchanger. The cooling chamber includes a first inlet adapted to receive a product at an elevated temperature (T1), a second inlet adapted to receive a second coolant (Coolant-II) at a low temperature (T2), and an outlet adapted to release a combination of the product and Coolant-II at a low temperature ($T_{out}$) and pressure ($P_{out}$). The cooling of the product from T1 to $T_{out}$ does not cause a phase change in the product.

A method of rapidly cooling food products in food-processing is also disclosed. The method includes inletting a first coolant (Coolant-I) at a first temperature into a heat exchanger. The method also includes ejecting Coolant-I at a second temperature from the heat exchanger. Additionally, the method includes inletting a product at an elevated temperature (T1) via a first inlet into a cooling chamber in thermal communication with the heat exchanger. Furthermore, the method includes inletting a second coolant (Coolant-II) at a low temperature (T2) via a second inlet into the cooling chamber. The method also includes releasing a combination of the product and Coolant-II at a low temperature ($T_{out}$) and pressure ($P_{out}$) via an outlet from the cooling chamber. The cooling of the product from T1 to $T_{out}$ does not cause a phase change in the product.

DETAILED DESCRIPTION

Figure 1:
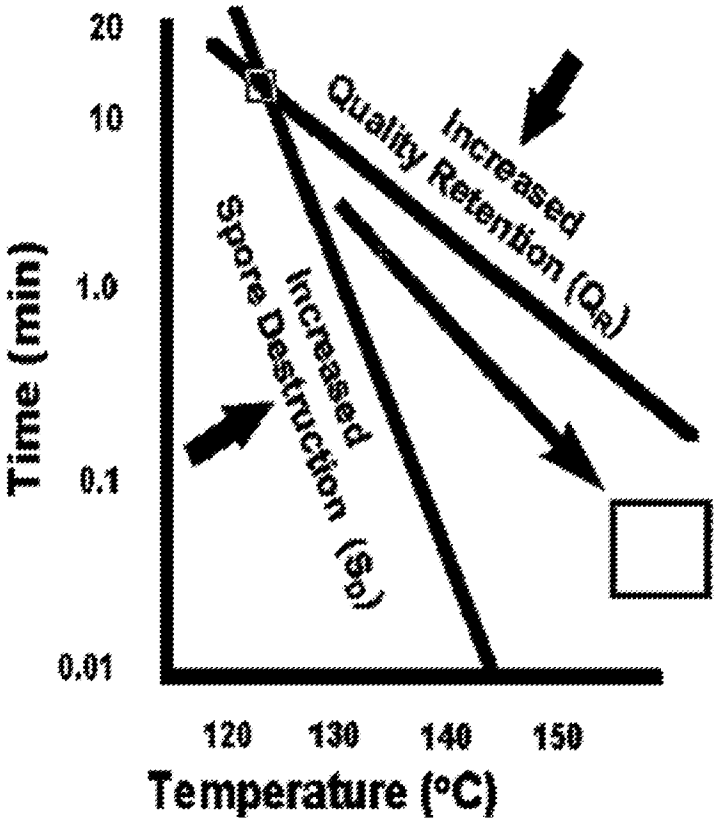
FIG. 1 is a graph of time in min vs. temperature in ° C. which represents the effect of time and temperature on spore destruction and retention of quality in food products.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

In the present disclosure, the term "about" can allow for a degree of variability in a value or range, for example, within 10%, within 5%, or within 1% of a stated value or of a stated limit of a range.

In the present disclosure, the term "substantially" can allow for a degree of variability in a value or range, for example, within 90%, within 95%, or within 99% of a stated value or of a stated limit of a range.

A novel approach in cooling or rapid cooling foods that have been heated for the purpose of destroying microorganisms is presented that avoids a phase change in the product during the cooling process. The rapid cooling technology of the present disclosure (RCT) provides an effective and fast cooling of heated food products in the liquid form. The RCT can be integrated with existing aseptic systems as well as could be standalone system. RCT can be used with any aseptic system with traditional tubular heat exchanger, microwave heating or ohmic heating. In combination with the microwave technology for continuous flow systems, RCT is the only option to obtain effective overall quality of the food product.

Figure 2:
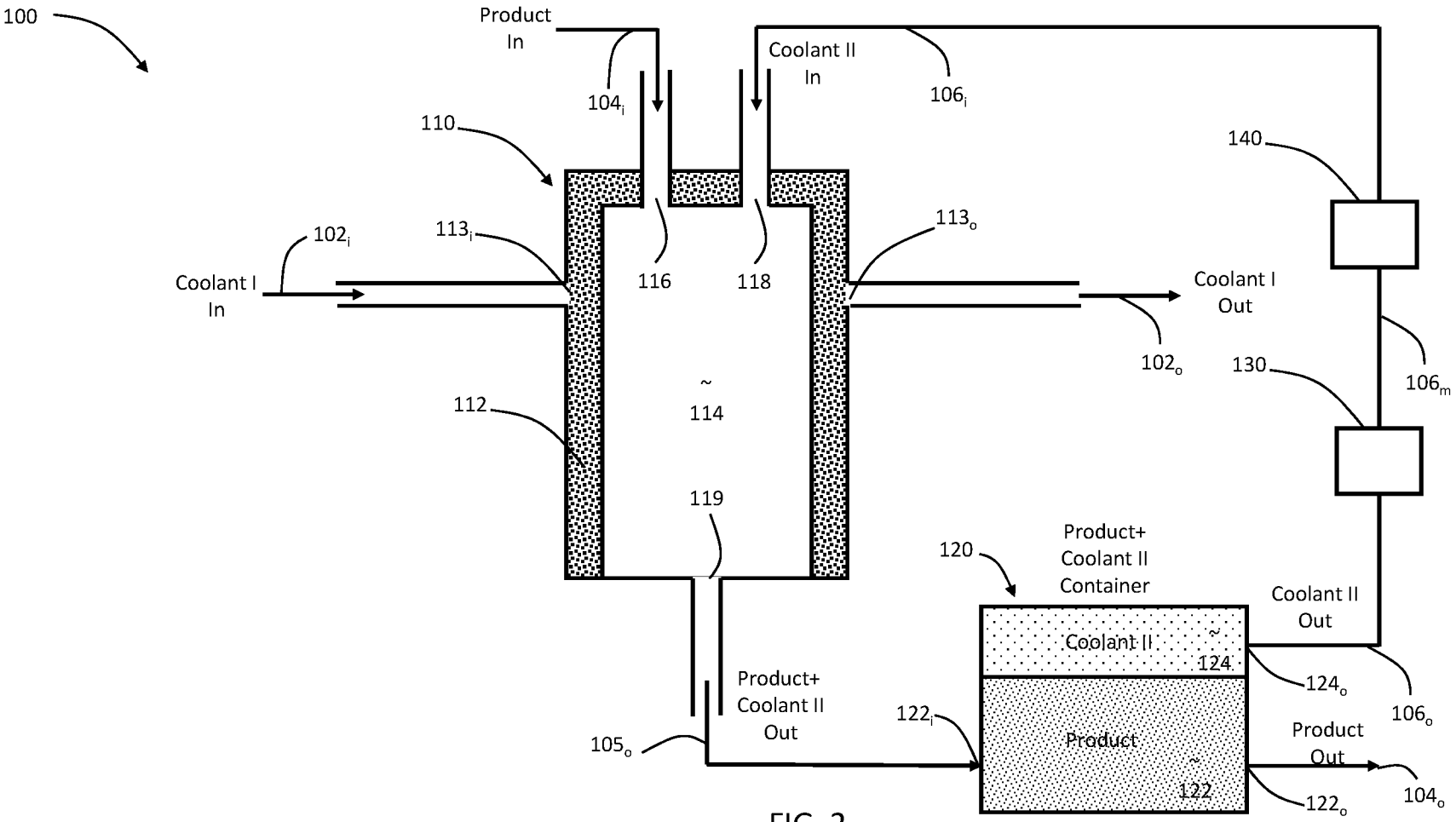
FIG. 2 is a schematic of a rapid cooling system, according to the present disclosure.

The RCT is adapted to process fruit and vegetable products. Referring to FIG. 2, a schematic diagram of the RCT system 100 according to the present disclosure is provided. The RCT system 100 includes a cooling compartment 110 and a product-coolant separation chamber 120. The cooling compartment 110 is divided into a heat exchanger 112, a cooling chamber 114, a chiller 130, and a compressor 140. The heat exchanger 112 includes an inlet $\mathbf{113}_i$ adapted to allow a first coolant at a low temperature $\mathbf{102}_i$ into the heat exchange 112 and an outlet $\mathbf{113}_o$ adapted to allow Coolant-I at a high temperature $\mathbf{102}_o$ out. The cooling chamber 114 also includes inlets and outlets. In particular, the cooling chamber 114 includes an inlet 116 adapted to allow product to be cooled at a high temperature $\mathbf{104}_i$ into the cooling chamber 114. The cooling chamber 114 also includes an inlet 118 adapted to allow a second coolant (Coolant-II) at a low temperature-high pressure $\mathbf{106}_i$ into the cooling chamber 114. The cooling chamber 114 also includes an outlet 119 adapted to allow product mixed with Coolant-II at a cooled temperature $\mathbf{105}_o$ out of the cooling chamber 114.

The RCT system 100 also includes the product-coolant separation chamber 120. The product-coolant separation chamber 120 includes two compartment: a product compartment 122 and a coolant compartment 124 where Coolant-II is separated from the product. The product-coolant separation chamber 120 includes an inlet $\mathbf{122}_i$ adapted to allow the product mixed with Coolant-II at a cooled temperature $\mathbf{105}_o$ into the product compartment 122. The product compartment also includes an outlet $\mathbf{122}_o$ adapted to allow product at a low temperature $\mathbf{104}_o$ out. The coolant compartment 124 allows Coolant-II to be separated from the product mixed with Coolant-II at a cooled temperature $\mathbf{105}_o$. The coolant compartment 124 includes an outlet $\mathbf{124}_o$ adapted to allow Coolant-II at a high temperature $\mathbf{106}_o$ to leave the coolant compartment 124.

The RCT system 100 also includes the chiller 130. The chiller 130 is adapted to receive the Coolant-II at a high temperature $\mathbf{106}_o$ and cool and outlet the Coolant-II at a low temperature-low pressure $\mathbf{106}_m$. The RCT system 100 also includes the compressor 140. The compressor 140 is adapted to receive the Coolant-II at a low temperature-low pressure $\mathbf{106}_m$ and pressurize and outlet the Coolant-II at a low temperature-high pressure $\mathbf{106}_i$ to be injected into the cooling chamber 114.

Also, the RCT system 100 includes a second chiller (not shown) and a second compressor (not shown) adapted together to receive the Coolant-I at a high temperature $\mathbf{102}_o$ and cool and outlet the Coolant-I at a low temperature $\mathbf{102}_i$ to be used by the heat exchanger 112.

The product at a high temperature $\mathbf{104}_i$ enters into the cooling chamber 114 through a nozzle located at the inlet 116. The temperature and pressure at the nozzle are in the range of aseptic processing of between about 150° F. to about 310° F. and between about 80 psi to about 5000 psi, respectively. In order to improve the efficiency of the cooling, inlet 118 allows pressurized Coolant-II at a low temperature-high pressure $\mathbf{106}_i$ into the cooling chamber 114. Coolant-II consists of an inert gas, e.g., nitrogen, at temperatures that will rapidly cool but not freeze the product (i.e., change the phase of the product). The RCT system 100 is configured to allow the pressurized Coolant-II at a low temperature-high pressure $\mathbf{106}_i$ into the cooling chamber 114 to i) displace unwanted gases (e.g., gases that can oxidize the product); and ii) provide a positive pressure for the Product+Coolant-II to exit from the outlet 119.

The governing heat transfer are defined by the following equations:

$$\rho C_p \frac{\partial T}{\partial t} + \rho C_p u \cdot \nabla T + \nabla \cdot q = Q + Q_p + Q_{vd}$$

$$q = -k \nabla T,$$

where

T is the temperature of the product, $C_p$ is the specific heat capacity of the product, ρ is the density of the product, u is the fluid dynamic viscosity of the product, Q is the thermal energy of the product, $Q_p$ is the pressure work of the product, $Q_{vd}$ is the viscous dissipation of the product, and q is the heat flux of the product. Convective heat flux boundaries at all product/Coolant-II interfaces is defined by:

$$q_0 = h \cdot (T_{ext} - T), \text{ where}$$

h is heat transfer coefficient, and $T_{ext}$ is the product temperature. For the coupling of heat transfer with the fluid flow of the streams, following equations are used:

Laminar Flow:

$$\rho\frac{\partial u}{\partial t}+\rho(u\cdot\nabla)=\nabla\cdot[-p1+\mu(\nabla u+(\nabla u)^T)]+F$$

$$\rho\nabla\cdot(u)=0,$$

where the level-set function is defined as:

$$\frac{\partial\phi}{\partial t}+\nabla\cdot(u\phi)=\gamma\nabla\cdot\left(\epsilon_{ls}\nabla\phi-\phi(1-\phi)\frac{\nabla\phi}{|\nabla\phi|}\right)+F,$$

where

F is body force.

Those having ordinary skill in the art will recognize that numerous modifications can be made to the specific implementations described above. The implementations should not be limited to the particular limitations described. Other implementations may be possible.

The invention claimed is:

1. A rapid cooling system for processing food, comprising:

a heat exchanger adapted to receive a first coolant (Coolant-I) at a first temperature and eject Coolant-I at a second temperature, a cooling chamber disposed within the heat exchanger in thermal communication with the heat exchanger, the cooling chamber comprising:

a first inlet adapted to receive a product at an elevated temperature (T1);

a second inlet adapted to receive a second coolant (Coolant-II) at a low temperature (T2);

an outlet adapted to release a combination of the product and Coolant-II at a low temperature ($T_{out}$) and pressure ($P_{out}$), wherein cooling of the product from T1 to $T_{out}$ does not cause a phase change in the product and Coolant-II, and wherein Coolant-II is recirculated from the outlet to the second inlet.

2. The rapid cooling system of claim 1, wherein the first inlet of the cooling chamber is a nozzle.

3. The rapid cooling system of claim 2, wherein pressure at the nozzle is between about 80 psi and about 5000 psi.

4. The rapid cooling system of claim 3, wherein temperature at the nozzle (T1) is between about 150° F. and about 310° F.

5. The rapid cooling system of claim 4, wherein $T_{out}$ is between about 40° F. and about 180° F.

6. The rapid cooling system of claim 4, wherein $P_{out}$ is between about 10 psi and about 5000 psi.

7. The rapid cooling system of claim 1, wherein Coolant-II is introduced into the cooling chamber at a pressure $PC_{in}$ between about 80 psi and about 5000 psi.

8. The rapid cooling system of claim 7, wherein the release of Coolant-II through the second inlet purges gases and liquids out of the cooling chamber prior to the introduction of the product into the cooling chamber through the first inlet.

9. The rapid cooling system of claim 7, further comprising:

a product-coolant separation chamber, adapted to receive the combination of the product and Coolant-II at $T_{out}$ from the outlet of the cooling chamber, the product-coolant separation chamber comprising:

a product compartment adapted to hold the product at or about $T_{out}$ separated from Coolant-II; and a coolant compartment where Coolant-II at or about $T_{out}$ is separated from the product.

10. The rapid cooling system of claim 9, further comprising:

a chiller configured to receive Coolant-II at or about $T_{out}$ and cool Coolant-II to about T2; and a compressor configured to pressurize Coolant-II from about $P_{out}$ to about $PC_{in}$.

11. A method of rapidly cooling food products in food-processing, comprising:

inletting a first coolant (Coolant-I) at a first temperature into a heat exchanger;

ejecting Coolant-I at a second temperature from the heat exchanger;

inletting a product at an elevated temperature (T1) via a first inlet into a cooling chamber in thermal communication with the heat exchanger;

inletting a second coolant (Coolant-II) at a low temperature (T2) via a second inlet into the cooling chamber;

releasing a combination of the product and Coolant-II at a low temperature ($T_{out}$) and pressure ($P_{out}$) via an outlet from the cooling chamber; and recirculating Coolant-II from the outlet to the second inlet, wherein cooling of the product from T1 to $T_{out}$ does not cause a phase change in the product and Coolant-II.

12. The method of claim 11, wherein the first inlet of the cooling chamber is a nozzle.

13. The method of claim 12, wherein pressure at the nozzle is between about 80 psi and about 5000 psi.

14. The method of claim 13, wherein temperature at the nozzle (T1) is between about 150° F. and about 310° F.

15. The method of claim 14, wherein $T_{out}$ is between about 40° F. and about 180° F.

16. The method of claim 14, wherein $P_{out}$ is between about 10 psi and about 5000 psi.

17. The method of claim 11, wherein Coolant-II is introduced into the cooling chamber at a pressure $PC_{in}$ between about 80 psi and about 5000 psi.

18. The method of claim 17, wherein the release of Coolant-II through the second inlet purges gases and liquids out of the cooling chamber prior to the introduction of the product into the cooling chamber through the first inlet.

19. The method of claim 17, further comprising:

collecting the product and Coolant-II at $T_{out}$ from the outlet of the cooling chamber into a product-coolant separation chamber;

separating the product from Coolant-II in a product compartment at or about $T_{out}$; and colleting Coolant-II at or about $T_{out}$ in a coolant compartment.

20. The method of claim 19, further comprising:

chilling Coolant-II from at or about $T_{out}$ to about T2; and compressing Coolant-II from about $P_{out}$ to about $PC_{in}$.

* * * * *